US010412818B2

(12) United States Patent
Totsuka et al.

(10) Patent No.: US 10,412,818 B2
(45) Date of Patent: Sep. 10, 2019

(54) X-RAY DIAGNOSTIC APPARATUS

(71) Applicant: Toshiba Medical Systems Corporation, Otawara-shi (JP)

(72) Inventors: Yuki Totsuka, Nasushiobara (JP); Akio Tetsuka, Shioyagun (JP); Masaharu Soya, Nasushiobara (JP)

(73) Assignee: Canon Medical Systems Corporation, Otawara-shi (JP)

( * ) Notice: Subject to any disclaimer, the term of this patent is extended or adjusted under 35 U.S.C. 154(b) by 296 days.

(21) Appl. No.: 15/292,487

(22) Filed: Oct. 13, 2016

(65) Prior Publication Data

US 2017/0118830 A1 Apr. 27, 2017

(30) Foreign Application Priority Data

Oct. 23, 2015 (JP) ..... 2015-208905

(51) Int. Cl.

| | |
|---|---|
| ***H05G 1/46*** | (2006.01) |
| ***H01J 35/06*** | (2006.01) |
| ***H01J 35/08*** | (2006.01) |
| ***H05G 1/26*** | (2006.01) |

(52) U.S. Cl.

CPC ..... *H05G 1/46* (2013.01); *H01J 35/06* (2013.01); *H01J 35/08* (2013.01); *H05G 1/265* (2013.01)

(58) Field of Classification Search

None

See application file for complete search history.

(56) References Cited

U.S. PATENT DOCUMENTS 5,517,545 A * 5/1996 Nakamura ..... H05G 1/06 378/101

FOREIGN PATENT DOCUMENTS

| | | |
|---|---|---|
| JP | 54-123891 | 9/1979 |
| JP | 7-29532 | 1/1995 |
| JP | 7-240296 | 9/1995 |
| JP | 2004-139790 | 5/2004 |
| JP | 2006-120544 | 5/2006 |
| JP | 2008-77883 | 4/2008 |
| JP | 2011-115369 | 6/2011 |
| JP | 2015-171480 | 10/2015 |

OTHER PUBLICATIONS

Japanese Office Action dated Jul. 9, 2019 in Japanese Application No. 2015-208905, citing documents AO-AU, therein, 4 pages.

* cited by examiner

*Primary Examiner* — Hoon K Song

(74) *Attorney, Agent, or Firm* — Oblon, McClelland, Maier & Neustadt, L.L.P.

(57) ABSTRACT

An X-ray diagnostic apparatus according to embodiments includes an X-ray tube assembly and a grid potential control circuitry. The X-ray tube assembly includes a filament that emits electrons, a target that generates X-rays by receiving the electrons, and a grid having a potential for adjusting a potential gradient around the filament. The grid potential control circuitry switches the potential of the grid to a potential where the potential gradient around the filament becomes greater than a potential gradient generated by a potential of the filament and a potential of the target.

14 Claims, 14 Drawing Sheets

X-RAY DIAGNOSTIC APPARATUS

CROSS-REFERENCE TO RELATED APPLICATIONS

This application is based upon and claims the benefit of priority from Japanese Patent Application No. 2015-208905, filed on Oct. 23, 2015; the entire contents of which are incorporated herein by reference.

FIELD

Embodiments described herein relate generally to an X-ray diagnostic apparatus.

BACKGROUND

An X-ray tube assembly included in an X-ray diagnostic apparatus generates X-rays by causing an electric current to flow through a filament to emit thermal electrons and causing the thermal electrons to hit a target. The characteristics of the X-rays depend on a tube current flowing between the filament and the target. The tube current depends on the number of thermal electrons emitted from the filament. The number of thermal electrons emitted from the filament depends on a temperature of the filament. The temperature of the filament depends on a resistance of the filament and an electric current flowing through the filament. Therefore, the X-ray tube assembly changes the tube current by adjusting the electric current flowing through the filament and thereby adjusts the characteristics of the X-rays. However, it takes time for the temperature of the filament to change, so that it takes time to change the tube current, and therefore it takes time until a set X-ray condition (tube current) is achieved.

DETAILED DESCRIPTION

An X-ray diagnostic apparatus according to embodiments includes an X-ray tube assembly and grid potential control circuitry. The X-ray tube assembly includes a filament that emits electrons, a target that generates X-rays by receiving the electrons, and a grid having a potential for adjusting a potential gradient around the filament. The grid potential control circuitry switches the potential of the grid to a potential where the potential gradient around the filament becomes greater than a potential gradient generated by a potential of the filament and a potential of the target.

Hereinafter, the X-ray diagnostic apparatuses according to the embodiments will be described with reference to the drawings. In the embodiments described below, redundant description will be appropriately omitted.

First Embodiment

Figure 1:
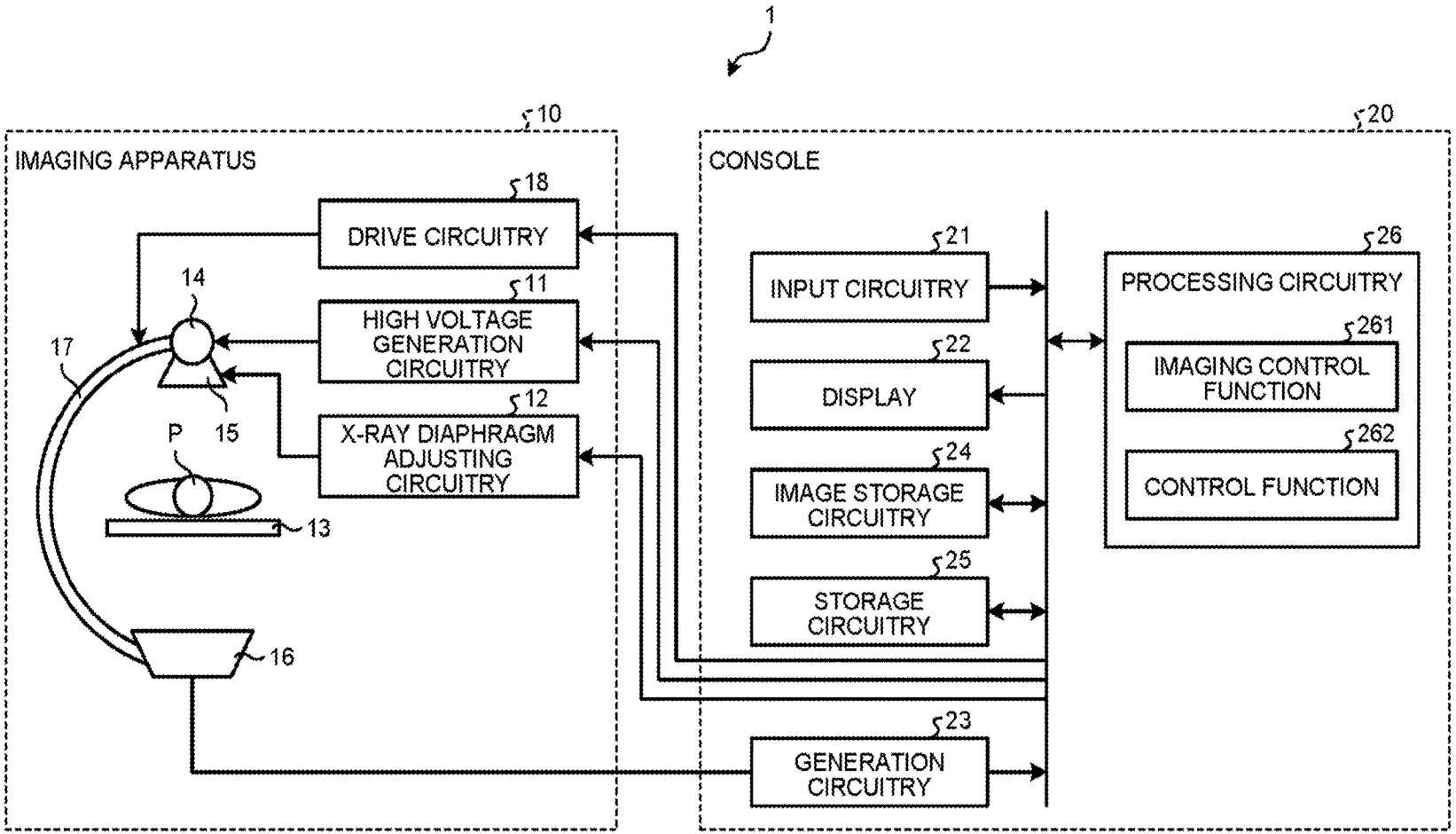
FIG. 1 is a block diagram illustrating a configuration example of an X-ray diagnostic apparatus according to a first embodiment.

First, a configuration of an X-ray diagnostic apparatus 1 according to a first embodiment will be described with reference to FIG. 1. FIG. 1 is a block diagram illustrating a configuration example of the X-ray diagnostic apparatus according to the first embodiment. As illustrated in FIG. 1, the X-ray diagnostic apparatus 1 includes an imaging apparatus 10 and a console 20. The configuration of the X-ray diagnostic apparatus 1 is not limited to a configuration described below.

The imaging apparatus 10 includes high voltage generation circuitry 11, X-ray diaphragm adjusting circuitry 12, a top board 13, an X-ray tube assembly 14, an X-ray diaphragm 15, an X-ray detector 16, a C arm 17, and drive circuitry 18.

The high voltage generation circuitry 11 supplies a high voltage to the X-ray tube assembly 14 to generate X-rays. The high voltage generation circuitry 11 realizes its function by reading a program stored in storage circuitry 25 described later and executing the program. The X-ray diaphragm adjusting circuitry 12 controls the X-ray diaphragm 15 and adjusts an irradiation range of the X-rays generated by the X-ray tube assembly 14. The X-ray diaphragm adjusting circuitry 12 realizes its function by reading a program stored in the storage circuitry 25 described later and executing the program.

The top board 13 is a plate-shaped member on which a subject P is put. The X-ray tube assembly 14 generates X-rays with which the subject P is irradiated by the high voltage supplied from the high voltage generation circuitry 11. The details of the X-ray tube assembly 14 will be described later.

The X-ray diaphragm 15 adjusts the irradiation range of the X-rays generated by the X-ray tube assembly 14. The X-ray diaphragm 15 is arranged between the X-ray tube assembly 14 and the X-ray detector 16. The X-ray diaphragm 15 has, for example, four slidable X-ray diaphragm blades and adjusts the irradiation range of the X-rays generated by the X-ray tube assembly 14 by sliding these X-ray diaphragm blades.

The X-ray detector 16 detects X-rays passing through the subject P. The X-ray detector 16 is, for example, an FPD (Flat Panel Detector). The X-ray detector 16 has detection elements arranged in a matrix form. The detection element converts the X-rays passing through the subject P into an electrical signal and accumulates the electrical signal. The accumulated electrical signal is transmitted to generation circuitry 23.

The C arm 17 holds a set of the X-ray tube assembly 14 and the X-ray diaphragm 15 and the X-ray detector 16 so that the set of the X-ray tube assembly 14 and the X-ray diaphragm 15 and the X-ray detector 16 face each other across the top board 13 and the subject P.

The drive circuitry 18 moves or rotates the C arm 17. The drive circuitry 18 changes an SID (Source Image receptor Distance) that is a distance between the X-ray tube assembly 14 and the X-ray detector 16. Further, the drive circuitry 18 can rotate the X-ray detector 16 held by the C arm 17 in a plane where the detection elements are arranged in a matrix form. Further, the drive circuitry 18 moves the top board on which the subject P is put in a horizontal direction and a vertical direction. The drive circuitry 18 realizes its function by reading a program stored in the storage circuitry 25 described later and executing the program.

The console 20 includes input circuitry 21, a display 22, the generation circuitry 23, image storage circuitry 24, the storage circuitry 25, and processing circuitry 26.

The input circuitry 21 is used by a user who inputs an instruction and a setting. The input circuitry 21 is included in, for example, a mouse and a keyboard. The input circuitry 21 transmits the instruction and the setting inputted by the user to the processing circuitry 26. The input circuitry 21 is realized by, for example, a processor.

The display 22 is a monitor to which the user refers. The display 22 is, for example, a liquid crystal display or an organic EL (Electroluminescence) display. The display 22 receives, for example, an instruction to display an X-ray image and a GUI (Graphical User Interface) used when a user inputs an instruction and a setting from the processing circuitry 26 and displays the X-ray image and the GUI.

The generation circuitry 23 generates an X-ray image based on electrical signals outputted from each detection element. The generation circuitry 23 realizes its function by reading a program stored in the storage circuitry 25 described later and executing the program. The generation circuitry 23 is realized by, for example, a processor.

The image storage circuitry 24 stores the X-ray image generated by the generation circuitry 23.

The storage circuitry 25 stores the programs for the high voltage generation circuitry 11, the X-ray diaphragm adjusting circuitry 12, and the drive circuitry 18 to realize the functions described above. The storage circuitry 25 stores programs for the generation circuitry 23 and the processing circuitry 26 to realize functions described below.

The image storage circuitry 24 and the storage circuitry 25 have a storage medium from which a computer can read stored information. The storage medium is, for example, a hard disk.

The processing circuitry 26 has an imaging control function 261 and a control function 262. The processing circuitry 26 is realized by, for example, a processor.

The imaging control function 261 is a function to control the high voltage generation circuitry 11, the X-ray diaphragm adjusting circuitry 12, the drive circuitry 18, and the generation circuitry 23 and image an X-ray image. Specifically, the imaging control function 261 performs control as described below. First, the imaging control function 261 controls the drive circuitry 18 to move the X-ray tube assembly 14, the X-ray diaphragm 15, and the X-ray detector 16 to positions appropriate for imaging. Next, the imaging control function 261 controls the high voltage generation circuitry 11 and the X-ray diaphragm adjusting circuitry 12 to irradiate the subject P with X-rays. Then, the imaging control function 261 controls the generation circuitry 23 to generate an X-ray image. When imaging a moving image, the imaging control function 261 controls the generation circuitry 23 and performs the processing described above for each frame of the moving image.

The control function 262 is a function that receives a value of a tube current detected by tube current detection circuitry 145 described later and controls grid potential control circuitry 113 described later based on the value. The control function 262 includes a function to operate each component of the imaging apparatus 10 and the console 20 at an appropriate timing according to purpose and other functions.

Figure 2:
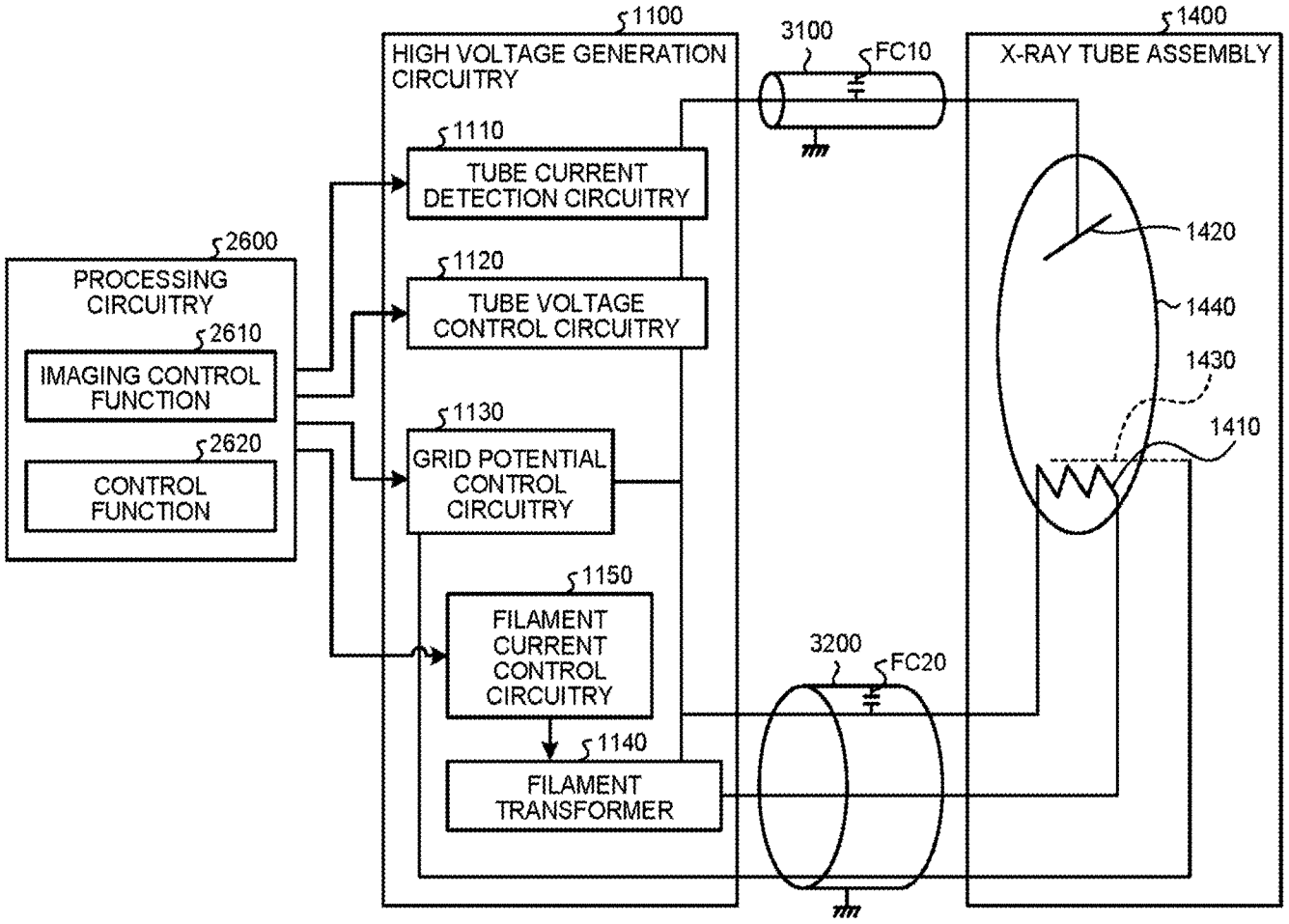
FIG. 2 is a diagram illustrating an example of conventional high voltage generation circuitry, X-ray tube assembly, and processing circuitry.

Next, high voltage generation circuitry, an X-ray tube assembly, and processing circuitry included in a conventional X-ray diagnostic apparatus will be described with reference to FIG. 2. FIG. 2 is a diagram illustrating an example of the conventional high voltage generation circuitry, X-ray tube assembly, and processing circuitry.

As illustrated in FIG. 2, the conventional X-ray diagnostic apparatus includes high voltage generation circuitry 1100, X-ray tube assembly 1400, processing circuitry 2600, a high-voltage cable 3100, and a high-voltage cable 3200.

The high voltage generation circuitry 1100 includes tube current detection circuitry 1110, tube voltage control circuitry 1120, grid potential control circuitry 1130, a filament transformer 1140, and filament current control circuitry 1150.

The tube current detection circuitry 1110 detects a tube current flowing between a filament 1410 described later and a target 1420 described later. Specifically, the tube current detection circuitry 1110 collects time series data of the tube current flowing between the filament 1410 and the target 1420. The tube voltage control circuitry 1120 controls a tube voltage applied between the filament 1410 and the target 1420. The grid potential control circuitry 1130 controls a potential of a grid 1430 described later. The filament transformer 1140 controls an electric current flowing through the filament 1410 described later. The filament current control circuitry 1150 transmits a signal to the filament transformer 1140 to control the filament transformer 1140. The tube current detection circuitry 1110, the tube voltage control circuitry 1120, the grid potential control circuitry 1130, and the filament current control circuitry 1150 are realized by, for example, a processor.

The X-ray tube assembly 1400 includes the filament 1410, the target 1420, the grid 1430, and a glass bulb 1440.

The filament 1410 emits electrons. Specifically, the filament 1410 is heated by an electric current supplied from the filament transformer 1140 described later and emits thermal electrons. The target 1420 generates X-rays by receiving the electrons emitted by the filament 1410. The grid 1430 is a structural object installed around the filament 1410. The grid 1430 adjusts a potential gradient around the filament 1410 and switches ON/OFF of the X-rays generated by the target 1420. The glass bulb 1440 is a glass container that contains the filament 1410, the target 1420, and the grid 1430. The details of the grid 1430 will be described later.

The high-voltage cable 3100 and the high-voltage cable 3200 electrically connect the high voltage generation circuitry 1100 and the X-ray tube assembly 1400. The tube current flows through one closed circuitry including the high voltage generation circuitry 1100, the X-ray tube assembly 1400, the high-voltage cable 3100, and the high-voltage cable 3200. The high-voltage cable 3100 and the high-voltage cable 3200 have a conducting wire which is arranged at the center of the cables and through which the tube current flows and an earth wire arranged around the conducting wire. A floating capacitance FC10 occurs between the conducting wire and the earth wire of the high-voltage cable 3100. A floating capacitance FC20 occurs between the conducting wire and the earth wire of the high-voltage cable 3200.

The processing circuitry 2600 has an imaging control function 2610 and a control function 2620. The processing circuitry 2600 is realized by, for example, a processor.

The imaging control function 2610 is a function to control the high voltage generation circuitry 1100, X-ray diaphragm adjusting circuitry, drive circuitry, and generation circuitry and photograph an X-ray image. Specifically, the imaging control function 2610 performs control as described below. First, the imaging control function 2610 controls the drive circuitry to move the X-ray tube assembly 1400, an X-ray diaphragm, and an X-ray detector to positions appropriate for imaging. Next, the imaging control function 2610 controls the high voltage generation circuitry 1100 and the X-ray diaphragm adjusting circuitry to irradiate the subject P with X-rays. Then, the imaging control function 2610 controls the generation circuitry to generate an X-ray image. When imaging a moving image, the imaging control function 2610 controls the generation circuitry and performs the processing described above for each frame of the moving image. The control function 2620 is a function to operate each component of the imaging apparatus and a console at an appropriate timing according to purpose and other functions.

Figure 3:
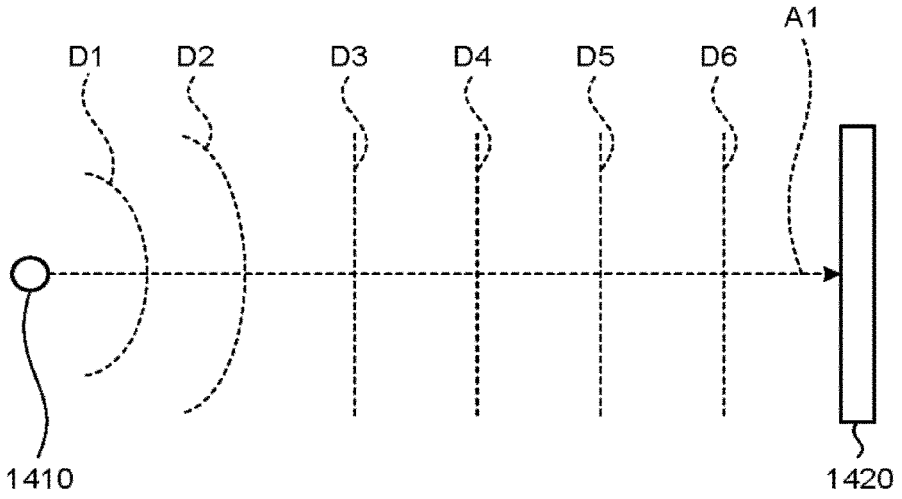
FIG. 3 is a diagram illustrating an example of a potential gradient generated by a potential of a filament and a potential of a target.
Figure 4:
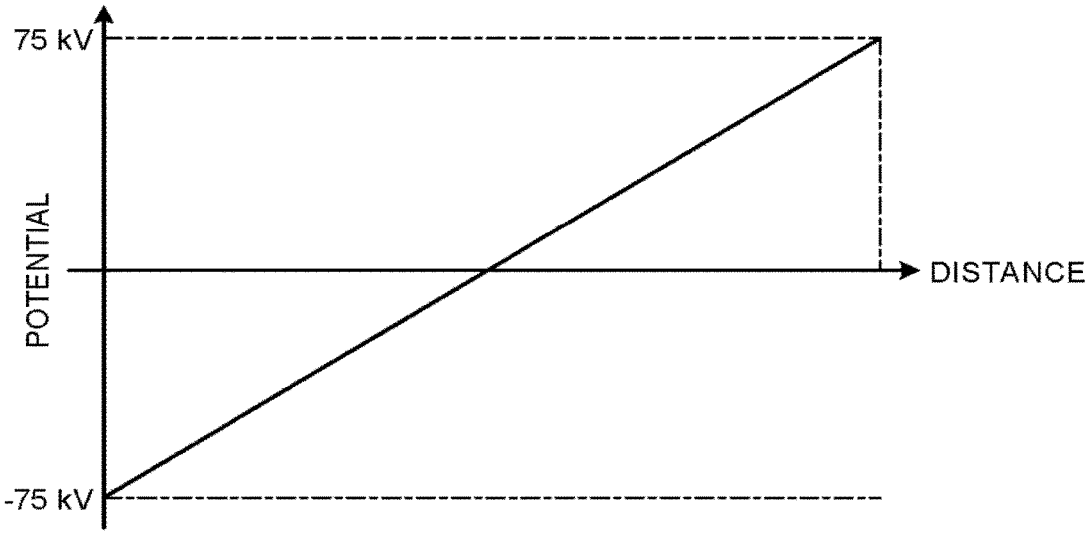
FIG. 4 is a diagram illustrating an example of a potential gradient on an arrow illustrated in FIG. 3.
Figure 5:
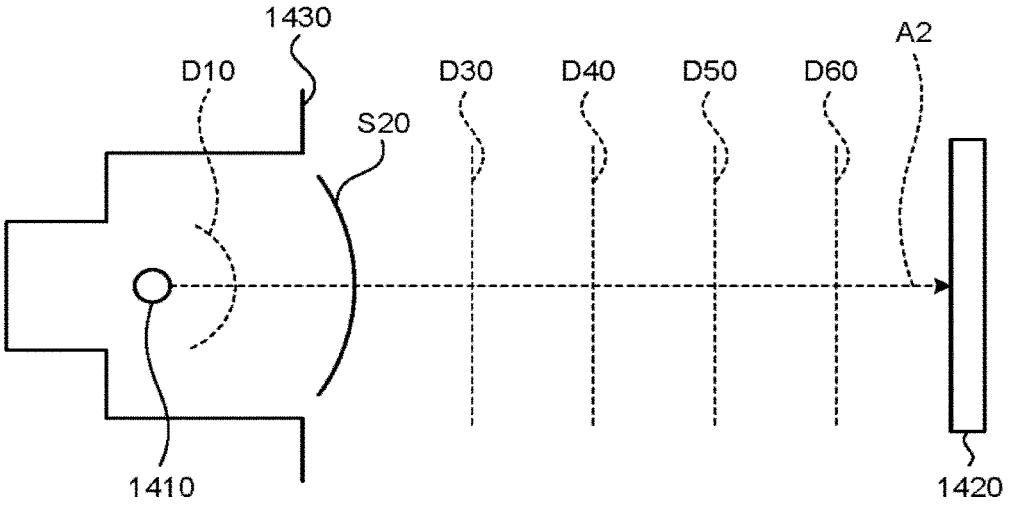
FIG. 5 is a diagram illustrating an example of a potential gradient generated by a potential of a filament, a potential of a target, and a potential of a grid.
Figure 6:
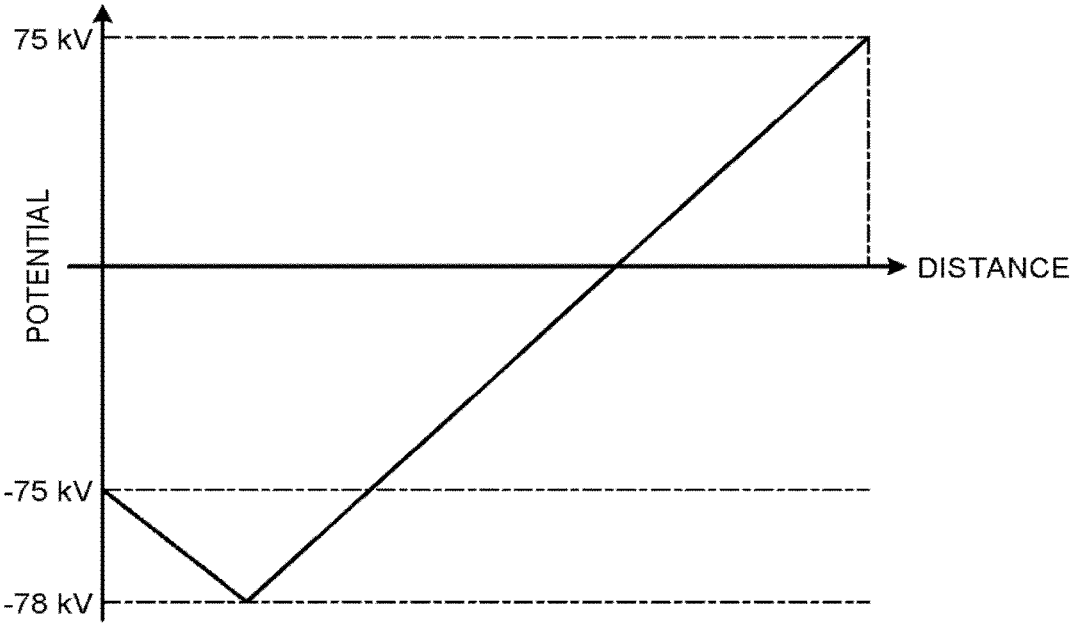
FIG. 6 is a diagram illustrating an example of a potential gradient on an arrow illustrated in FIG. 5.

Next, the grid 1430 will be described with reference to FIGS. 3 to 6. FIG. 3 is a diagram illustrating an example of a potential gradient generated by a potential of a filament and a potential of a target. FIG. 4 is a diagram illustrating an example of a potential gradient on an arrow illustrated in FIG. 3. FIG. 5 is a diagram illustrating an example of a potential gradient generated by a potential of a filament, a potential of a target, and a potential of a grid. FIG. 6 is a diagram illustrating an example of a potential gradient on an arrow illustrated in FIG. 5.

The filament 1410 and the target 1420 are applied to a potential by the tube voltage control circuitry 1120. The potential of the target 1420 is higher than the potential of the filament 1410. For example, the filament 1410 is applied a potential of −75 kV. For example, the target 1420 is applied a potential of 75 kV.

The potential of the filament 1410 and the potential of the target 1420 generate a potential gradient represented by, for example, a dashed line D1, a dashed line D2, a dashed line D3, a dashed line D4, a dashed line D5, and a dashed line D6 illustrated in FIG. 3. The dashed line D1, the dashed line D2, the dashed line D3, the dashed line D4, the dashed line D5, and the dashed line D6 are lines that connect points where the potential is the same. The potential increases from the filament 1410 to the target 1420. The potential on an arrow A1 illustrated in FIG. 3 is represented as a straight line with a positive slope from the filament 1410 to the target 1420 as illustrated in FIG. 4. Therefore, the potential gradient on the arrow A1 illustrated in FIG. 3 is constant.

In this case, the electrons emitted from the filament 1410 can hit the target 1420. Therefore, the grid 1430 can cause the electrons emitted from the filament 1410 to hit the target 1420 and generate X-rays.

However, when the grid potential control circuitry 1130 gives a potential to the grid 1430, the potential gradient illustrated in FIGS. 3 and 4 changes as described below.

The potential of the filament 1410, the potential of the target 1420, and the potential of the grid 1430 generate a potential gradient represented by, for example, a dashed line D10, a solid line S20, a dashed line D30, a dashed line D40, a dashed line D50, and a dashed line D60 illustrated in FIG. 5. The dashed line D10, the dashed line D30, the dashed line D40, the dashed line D50, and the dashed line D60 are lines that connect points where the potential is the same. The potential on the solid line S20 is a line that connects points where the potential is −78 kV.

The potential decreases from the filament 1410 to the solid line S20 and increases from the solid line S20 to the target 1420. As illustrated in FIG. 6, the potential on an arrow A2 illustrated in FIG. 5 is represented by a straight line with a negative slope from the filament 1410 to an intersection between the arrow A2 and the solid line S20 illustrated in FIG. 5 and is represented by a straight line with a positive slope from the intersection between the arrow A2 and the solid line S20 illustrated in FIG. 5 to the target 1420. Therefore, the potential gradient on the arrow A2 illustrated in FIG. 5 is a constant negative value from the filament 1410 to the intersection between the arrow A2 and the solid line S20 illustrated in FIG. 5 and is a constant positive value from the intersection between the arrow A2 and the solid line S20 illustrated in FIG. 5 to the target 1420.

In this case, the electrons emitted from the filament 1410 cannot hit the target 1420. Because a negative potential gradient occurs around the filament 1410 for the electrons emitted from the filament 1410. Therefore, the grid 1430 can prevent the electrons emitted from the filament 1410 from hitting the target 1420 and can prevent X-rays from being generated.

Figure 7:
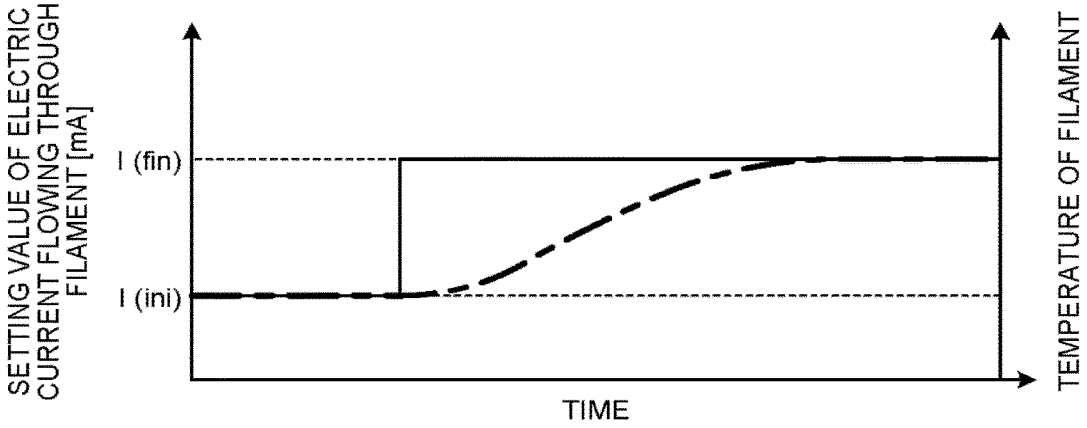
FIG. 7 is a diagram illustrating an example of time variations of a setting value of an electric current flowing through a filament and a temperature of the filament.
Figure 8:
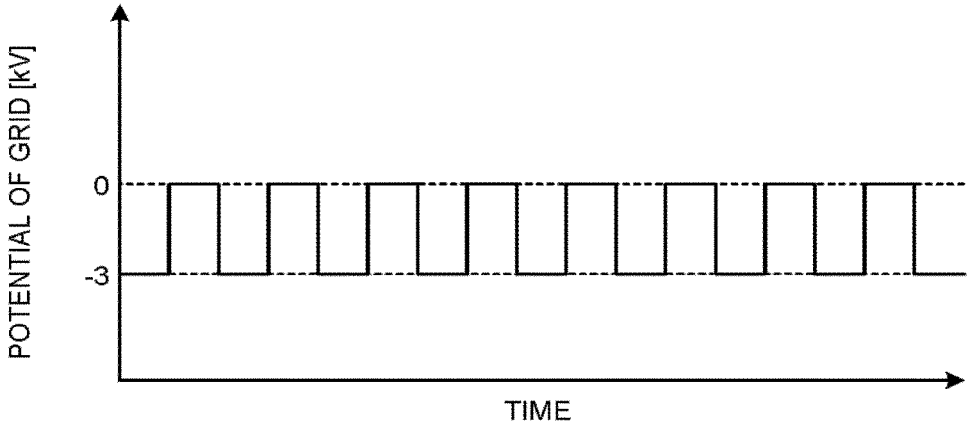
FIG. 8 is a diagram illustrating an example of grid potential control performed by grid potential control circuitry according to a conventional X-ray diagnostic apparatus.
Figure 9:
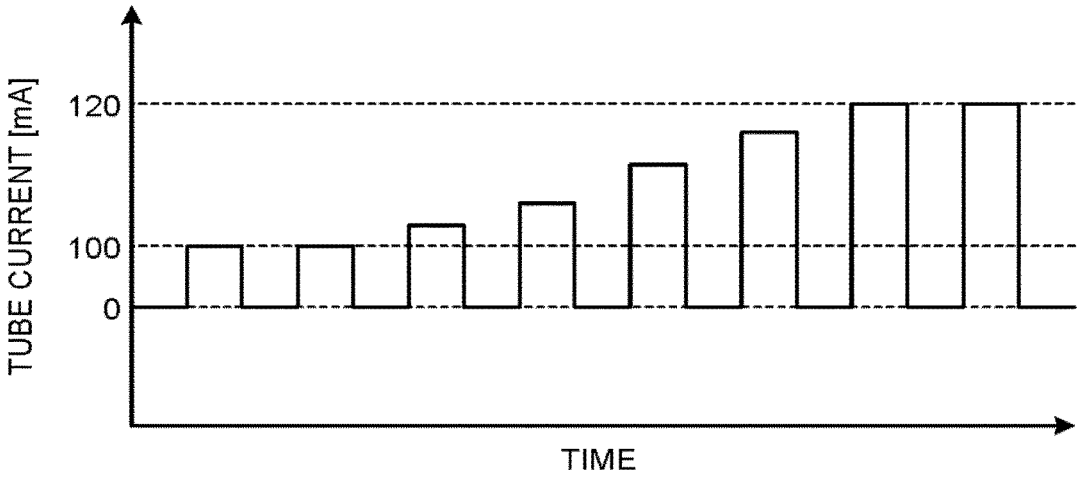
FIG. 9 is a diagram illustrating an example of time variation of a tube current by the grid potential control illustrated in FIG. 8.

Next, a method for the conventional X-ray diagnostic apparatus to change the tube current to a target tube current greater than the tube current will be described with reference to FIGS. 7 to 9. FIG. 7 is a diagram illustrating an example of time variations of a setting value of an electric current flowing through a filament and a temperature of the filament. FIG. 8 is a diagram illustrating an example of control of grid potential performed by grid potential control circuitry according to the conventional X-ray diagnostic apparatus. FIG. 9 is a diagram illustrating an example of time variation of a tube current by the grid potential control illustrated in FIG. 8. In the description below, a case where the conventional X-ray diagnostic apparatus performs pulse fluoroscopy is used as an example.

As illustrated by a solid line in FIG. 7, the filament current control circuitry 1150 switches a setting value of an electric current flowing through the filament 1410 from I(ini)=100 mA to I(fin)=120 mA. I(fin)=120 mA is greater than I(ini)=100 mA. Therefore, the temperature of the filament 1410 gradually rises and converges to a constant temperature as illustrated in FIG. 7 by a dashed-dotted line. The grid potential control circuitry 1130 periodically changes the potential of the grid 1430. For example, as illustrated in FIG. 8, the grid potential control circuitry 1130 sets the potential of the grid 1430 to 0 kV when X-rays are applied and sets the potential of the grid 1430 to −3 kV when X-rays are not applied.

The grid potential control circuitry 1130 adjusts the potential of the grid 1430 in a range in which electrical discharge does not occur between the filament 1410 and the grid 1430. The −3 kV described above is an example of a maximum potential difference where electrical discharge does not occur between the filament 1410 and the grid 1430.

When the temperature of the filament 1410 rises, the number of thermal electrons emitted from the filament 1410 increases and the tube current increases. Therefore, for example, as illustrated in FIG. 9, the tube current gradually rises from 100 mA and converges to 120 mA, which is a target tube current, following the temperature change of the filament 1410.

As described above, even when the setting value of the electric current flowing through the filament 1410 is switched, it takes time for the temperature of the filament 1410 to rise. Therefore, it may be difficult for the X-ray tube assembly 1400 to quickly switch the characteristics of the X-rays to be generated. Therefore, when the X-ray tube assembly 1400 starts generating X-rays or when fluoroscopic automatic brightness control is activated and the thickness of the subject changes, it may take time until a target brightness of the X-ray image is obtained.

Figure 10:
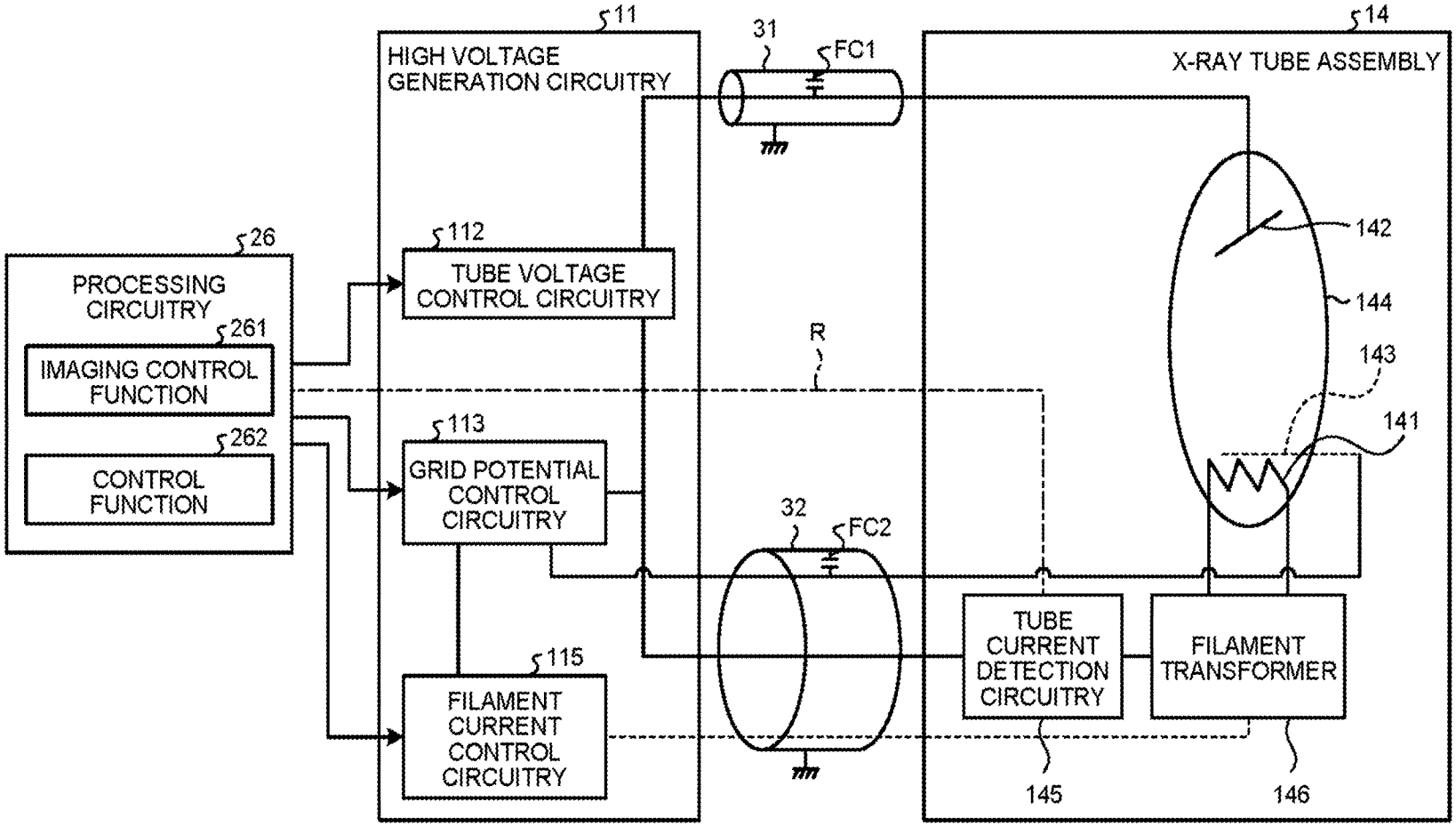
FIG. 10 is a diagram illustrating an example of high voltage generation circuitry, an X-ray tube assembly, processing circuitry, and a path through which a value of a tube current detected by tube current detection circuitry is transmitted according to the first embodiment.

Next, an X-ray tube assembly, high voltage generation circuitry, processing circuitry, and a path through which a value of a tube current detected by tube current detection circuitry is transmitted, which are included in the X-ray diagnostic apparatus 1 according to the first embodiment, will be described with reference to FIG. 10. FIG. 10 is a diagram illustrating an example of the high voltage generation circuitry, the X-ray tube assembly, the processing circuitry, and the path through which a value of a tube current detected by the tube current detection circuitry is transmitted according to the first embodiment. In the description below, a case where the X-ray diagnostic apparatus 1 according to the first embodiment performs pulse fluoroscopy is used as an example.

The high voltage generation circuitry 11 includes tube voltage control circuitry 112, the grid potential control circuitry 113, and filament current control circuitry 115.

The tube voltage control circuitry 112 controls a tube voltage applied between a filament 141 described later and a target 142 described later. The grid potential control circuitry 113 switches a potential of a grid 143 described later to a potential where a potential gradient around the filament 141 becomes greater than a potential gradient generated by a potential of the filament 141 and a potential of the target 142. The details of the grid potential control circuitry 113 will be described later. The filament current control circuitry 115 transmits a signal to a filament transformer 146 described later to control the filament transformer 146. The tube voltage control circuitry 112, the grid potential control circuitry 113, and the filament current control circuitry 115 are realized by, for example, a processor.

The X-ray tube assembly 14 includes the filament 141, the target 142, the grid 143, a glass bulb 144, the tube current detection circuitry 145, and the filament transformer 146.

The filament 141 emits electrons. Specifically, the filament 141 is heated by an electric current supplied from the filament transformer 146 described later and emits thermal electrons. The target 142 generates X-rays by receiving the electrons emitted by the filament 141. The grid 143 is a structural object installed around the filament 141. The grid 143 has a potential for adjusting a potential gradient around the filament 141. The details of the grid 143 will be described later. The grid 143 can switch ON/OFF of the X-rays generated by the target 142 by the potential. The glass bulb 144 is a glass container that contains the filament 141, the target 142, and the grid 143.

As illustrated in FIG. 10, the tube current detection circuitry 145 is installed in the X-ray tube assembly 14. The tube current detection circuitry 145 detects a tube current flowing between the filament 141 and the target 142. Specifically, the tube current detection circuitry 145 immediately collects time series data of the tube current flowing between the filament 141 and the target 142. The value of the tube current detected by the tube current detection circuitry 145 is transmitted to the processing circuitry 26 through a path R described later.

As illustrated in FIG. 10, the filament transformer 146 is installed in the X-ray tube assembly 14. The filament transformer 146 controls an electric current flowing through the filament 141. Thereby, the filament transformer 146 adjusts the number of thermal electrons emitted from the filament 141 to change the tube current.

The path R is a path for transmitting the value of the tube current detected by the tube current detection circuitry 145 to the processing circuitry 26. For example, the path R is an optical cable or a photodetector connected to the processing circuitry 26. When the path R is a photodetector connected to the processing circuitry 26, the tube current detection circuitry 145 includes, for example, an LED. The path R is different from a path in which the tube current detected by the tube current detection circuitry 145 flows. The path R is electrically insulated from electronic components included in the X-ray tube assembly 14, a high-voltage cable 31, and a high-voltage cable 32.

Figure 11:
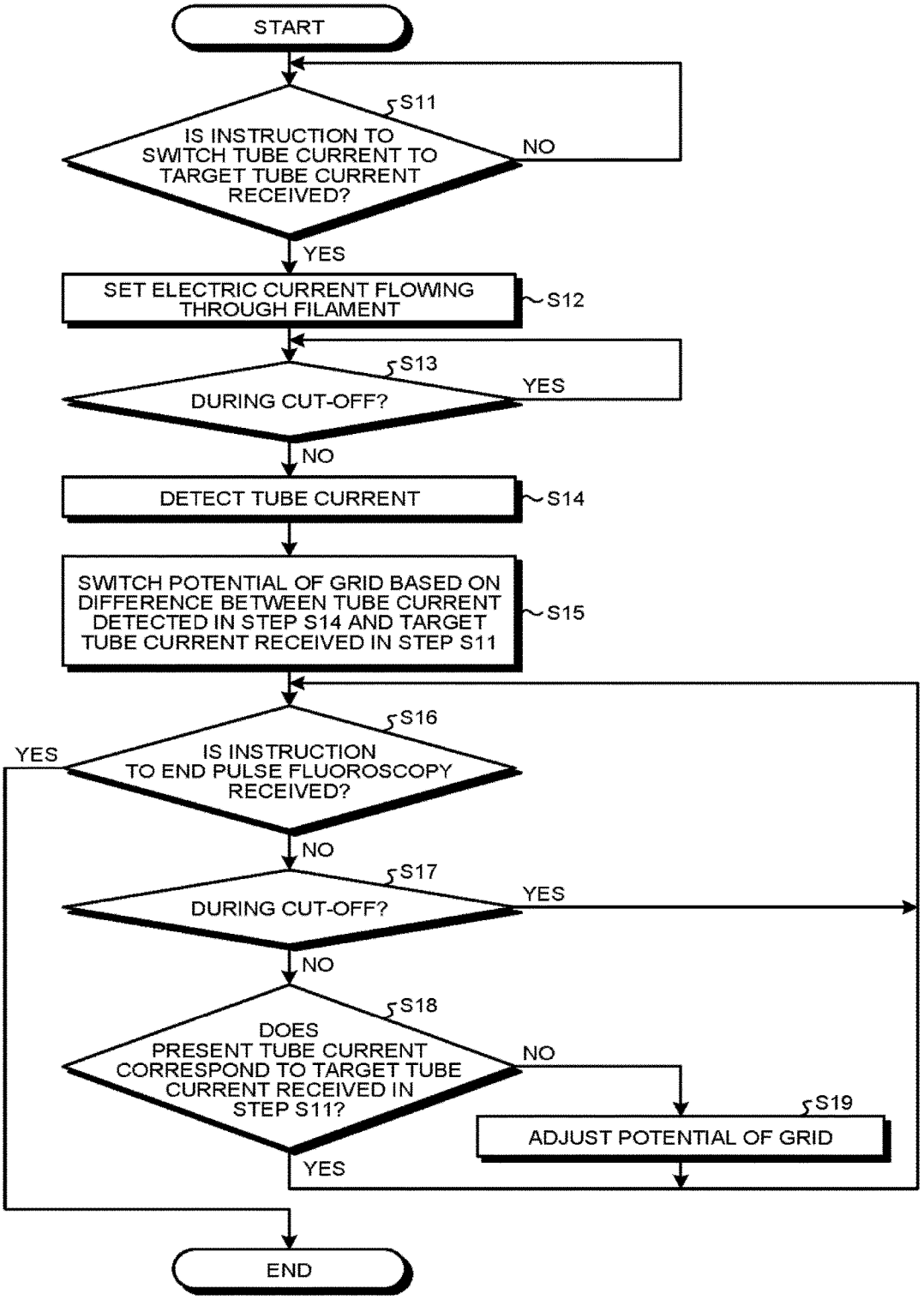
FIG. 11 is a flowchart illustrating an example of processing performed by the X-ray diagnostic apparatus according to the first embodiment.
Figure 12:
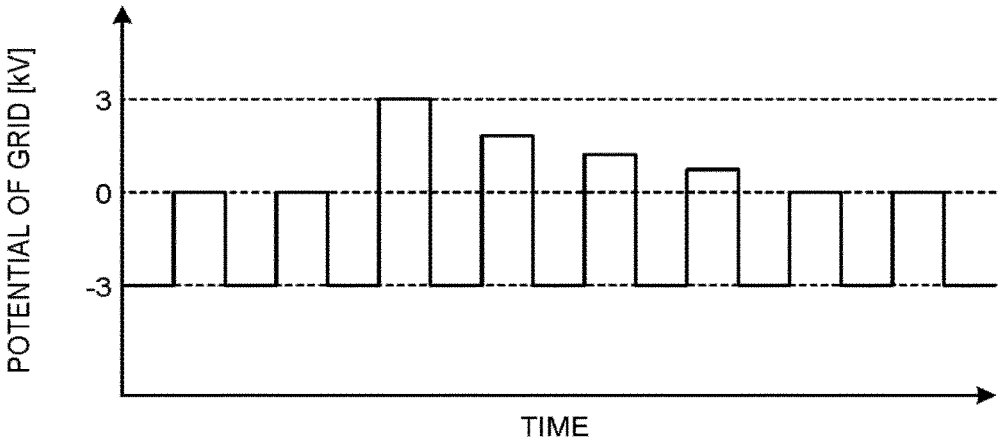
FIG. 12 is a diagram illustrating an example of grid potential control performed by the grid potential control circuitry according to the first embodiment.
Figure 13:
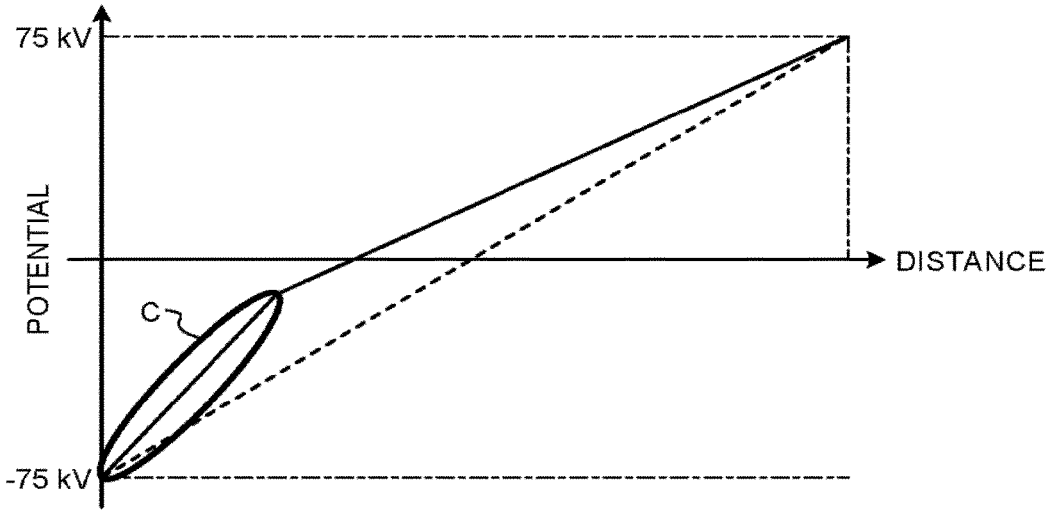
FIG. 13 is a diagram illustrating an example of a potential gradient generated by the potential of the filament, the potential of the target, and the potential of the grid and a potential gradient generated by the potential of the filament and the potential of the target.
Figure 14:
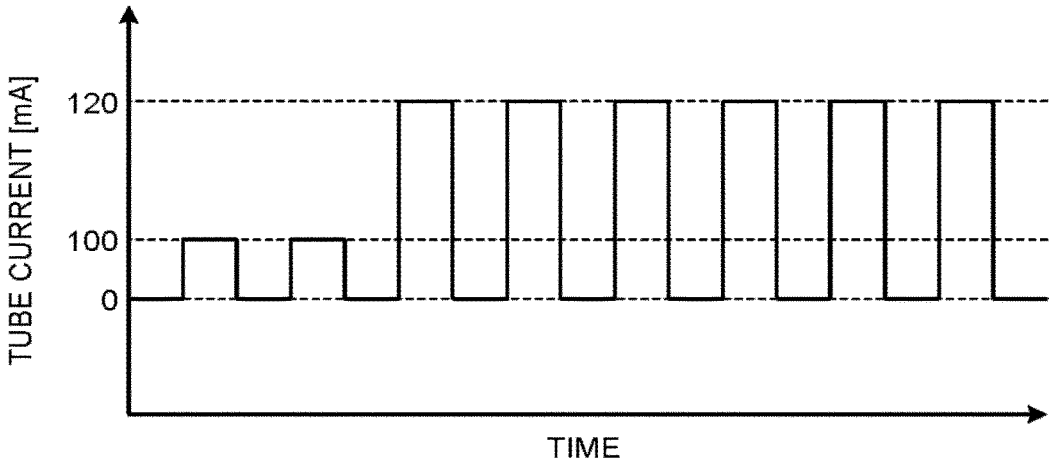
FIG. 14 is a diagram illustrating an example of time variation of a tube current by the grid potential control illustrated in FIG. 13.
Figure 15:
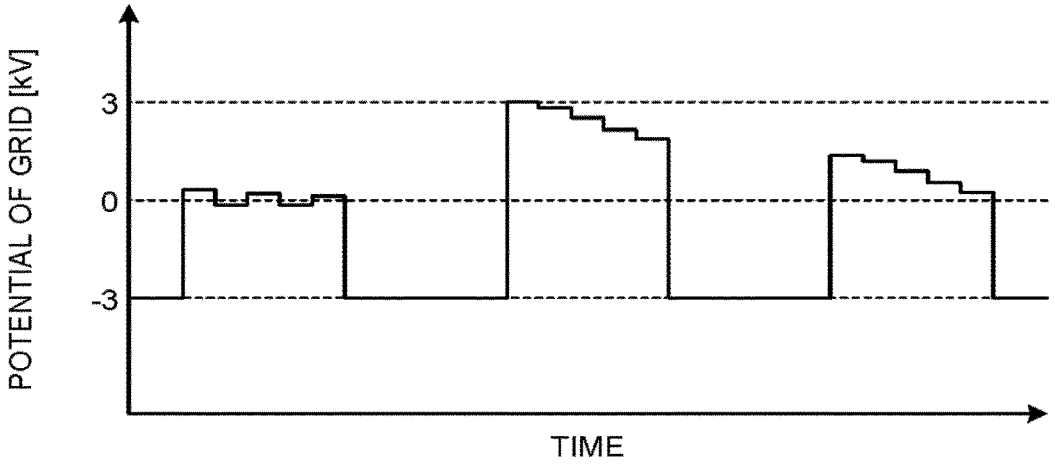
FIG. 15 is a diagram illustrating an example of grid potential control performed by the grid potential control circuitry according to the first embodiment.
Figure 16:
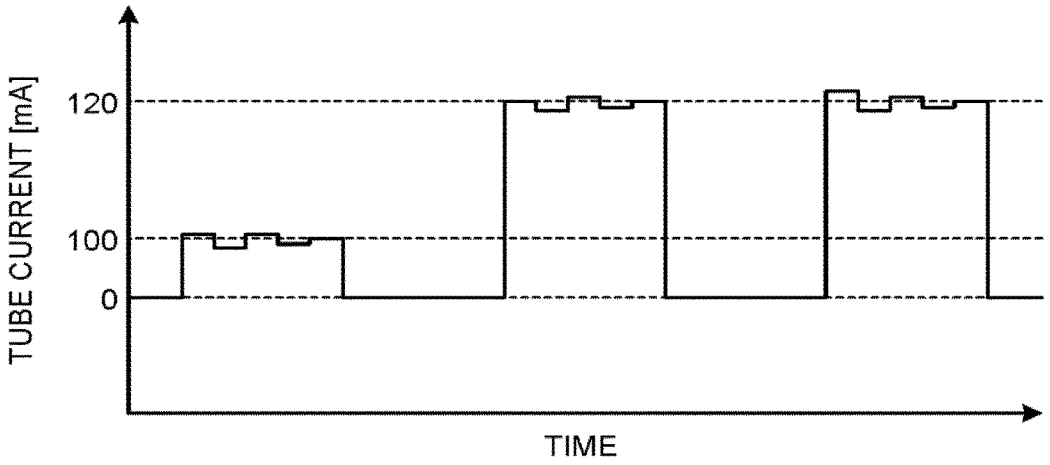
FIG. 16 is a diagram illustrating an example of time variation of a tube current by the grid potential control illustrated in FIG. 15.

Next, an example of processing performed by the X-ray diagnostic apparatus 1 according to the first embodiment will be described with reference to FIGS. 7 and 11 to 16. FIG. 11 is a flowchart illustrating an example of processing performed by the X-ray diagnostic apparatus according to the first embodiment. FIG. 12 is a diagram illustrating an example of grid potential control performed by the grid potential control circuitry according to the first embodiment. FIG. 13 is a diagram illustrating an example of a potential gradient generated by the potential of the filament, the potential of the target, and the potential of the grid and a potential gradient generated by the potential of the filament and the potential of the target. FIG. 14 is a diagram illustrating an example of time variation of a tube current by the grid potential control illustrated in FIG. 13. FIG. 15 is a diagram illustrating an example of grid potential control performed by the grid potential control circuitry according to the first embodiment. FIG. 16 is a diagram illustrating an example of time variation of a tube current by the grid potential control illustrated in FIG. 15.

As illustrated in FIG. 11, the processing circuitry 26 reads a program corresponding to the control function 262 from the storage circuitry 25 and executes the program and thereby determines whether an instruction to switch the tube current to the target tube current is received (step S11). For example, the processing circuitry 26 determines whether an instruction to switch to the target tube current of 120 mA illustrated in FIG. 14 is received. When the processing circuitry 26 determines that the instruction to switch the tube current to the target tube current is received (step S11: Yes), the processing circuitry 26 advances the processing to step S12. When the processing circuitry 26 determines that the instruction to switch the tube current to the target tube current is not received (step S11: No), the processing circuitry 26 waits until the instruction to switch the tube current to the target tube current is received. The instruction to switch the tube current to the target tube current includes an instruction to begin flowing the tube current.

As illustrated in FIG. 11, the filament current control circuitry 115 sets an electric current flowing through the filament 141 (step S12). For example, as illustrated by a solid line in FIG. 7, the filament current control circuitry 115 transmits a signal for switching a setting value of an electric current flowing through the filament 141 from I(ini)=100 mA to I(fin)=120 mA to the filament transformer 146. Thereby, the filament transformer 146 causes an electric current of I(fin)=120 mA to flow through the filament 141.

As illustrated in FIG. 11, the processing circuitry 26 reads the program corresponding to the control function 262 from the storage circuitry 25 and executes the program and thereby determines whether it is during cut-off (step S13). Here, the cut-off means that when the X-ray diagnostic apparatus 1 performs pulse fluoroscopy, the grid potential control circuitry 113 sets the potential of the grid 143 to be lower than the potential of the filament 141 and thereby causes no X-rays to be generated.

When the processing circuitry 26 determines that it is during cut-off (step S13: Yes), the processing circuitry 26 waits until the cut-off ends. When the processing circuitry 26 determines that it is not during cut-off (step S13: No), the processing circuitry 26 advances the processing to step S14.

For example, as illustrated in FIG. 12, the grid potential control circuitry 113 sets the potential of the grid 143 during cut-off to −3 kV. In FIG. 12, the times when the potential of the grid 143 is 0 kV or more correspond to each frame of the pulse fluoroscopy. Therefore, as illustrated in FIG. 12, the time variation of the potential of the grid 143 is represented as a pulse that periodically rises from −3 kV.

The tube current detection circuitry 145 detects the tube current (step S14). Specifically, the tube current detection circuitry 145 immediately detects the tube current. For example, the tube current detection circuitry 145 immediately detects the tube current of 100 mA illustrated in FIG. 14. The times when the tube current is 0 mA in FIG. 14 correspond to the times when the potential of the grid 143 is −3 kV in FIG. 12. In other words, the times when the tube current is 0 mA in FIG. 14 are during cut-off. The times when the tube current is not 0 mA in FIG. 14 correspond to each frame of the pulse fluoroscopy.

As illustrated in FIG. 11, the grid potential control circuitry 113 switches the potential of the grid 143 based on a difference between the tube current detected in step S14 and the target tube current received in step S11 (step S15). For example, as illustrated in FIG. 12, the grid potential control circuitry 113 switches the potential of the grid 143 from 0 kV to +3 kV based on a difference between the tube current of 100 mA detected in step S14 and the target tube current of 120 mA received in step S11. Thereby, the potential gradient between the filament 141 and the target 142 switches from a potential gradient illustrated by a dashed line illustrated in FIG. 13 to a potential gradient illustrated by a solid line illustrated in FIG. 13.

The potential gradient around the filament 141 before the grid potential control circuitry 113 switches the potential of the grid 143 is the potential gradient illustrated by the dashed line illustrated in FIG. 13. The potential gradient around the filament 141 after the grid potential control circuitry 113 switches the potential of the grid 143 is a potential gradient illustrated by a solid line surrounded by a curved line C illustrated in FIG. 13. As illustrated in FIG. 13, in the potential gradient illustrated by the solid line illustrated in FIG. 13, the potential gradient of a portion surrounded by the curved line C is greater than the potential gradient illustrated by the dashed line illustrated in FIG. 13. Therefore, the number of thermal electrons emitted from the filament 141 instantly increases when the grid potential control circuitry 113 switches the potential of the grid 143. Thus, for example, as illustrated in FIG. 14, the grid potential control circuitry 113 can switch the tube current from 100 mA to 120 mA which is the target tube current.

The number of thermal electrons emitted from the filament 141 increases as the potential gradient around the filament 141 increases. Therefore, the greater the difference between the tube current detected in step S14 and the target tube current received in step S11, the higher the potential to which the grid potential control circuitry 113 switches the potential of the grid 143 in step S15.

The grid potential control circuitry 113 adjusts the potential of the grid 143 in a range in which electrical discharge does not occur between the filament 141 and the grid 143. In other words, the grid potential control circuitry 113 adjusts the potential of the grid 143 in a range in which the thermal electrons emitted from the filament 141 are not drawn to the grid 143. Because the X-ray diagnostic apparatus 1 is required to cause the electrons emitted from the filament 141 to hit the target 142 in order to generate X-rays.

The +3 kV described above is an example of a maximum potential difference where electrical discharge does not occur between the filament 141 and the grid 143. Thereby, the grid potential control circuitry 113 can maximize the potential gradient around the filament 141 and maximize the number of thermal electrons emitted from the filament 141.

As illustrated in FIG. 11, the processing circuitry 26 reads the program corresponding to the control function 262 from the storage circuitry 25 and executes the program and thereby determines whether an instruction to end the pulse fluoroscopy is received (step S16). When the processing circuitry 26 receives the instruction to end the pulse fluoroscopy (step S16: Yes), the processing circuitry 26 ends the processing. When the processing circuitry 26 does not receive the instruction to end the pulse fluoroscopy (step S16: No), the processing circuitry 26 advances the processing to step S17.

As illustrated in FIG. 11, the processing circuitry 26 reads the program corresponding to the control function 262 from the storage circuitry 25 and executes the program and thereby determines whether it is during cut-off (step S17). When the processing circuitry 26 determines that it is during cut-off (step S17: Yes), the processing circuitry 26 returns the processing to step S16. When the processing circuitry 26 determines that it is not during cut-off (step S17: No), the processing circuitry 26 advances the processing to step S18.

As illustrated in FIG. 11, the processing circuitry 26 reads the program corresponding to the control function 262 from the storage circuitry 25 and executes the program and thereby determines whether a present tube current corresponds to the target tube current received in step S11 (step S18). For example, the processing circuitry 26 determines whether the present tube current corresponds to 120 mA which is the target tube current. Because the electric current flowing through the filament is switched in step S12, so that the temperature of the filament 141 changes and the present tube current may not correspond to the target tube current.

When the processing circuitry 26 determines that the present tube current corresponds to the target tube current received in step S11 (step S18: Yes), the processing circuitry 26 returns the processing to step S16. When the processing circuitry 26 determines that the present tube current does not correspond to the target tube current received in step S11 (step S18: No), the processing circuitry 26 advances the processing to step S19.

As illustrated in FIG. 11, the grid potential control circuitry 113 adjusts the potential of the grid (step S19). For example, the grid potential control circuitry 113 switches the tube current flowing between the filament 141 and the target 142 to the target tube current in step S15 and thereafter performs control to decrease the potential of the grid 143 when the tube current detected by the tube current detection circuitry 145 becomes greater than the target tube current and increase the potential of the grid 143 when the tube current detected by the tube current detection circuitry 145 becomes smaller than the target tube current. Thereby, the grid potential control circuitry 113 can cause the present tube current to correspond to the target tube current received by the processing circuitry 26 in step S11. After the adjustment of the potential of the grid is completed, the grid potential control circuitry 113 returns the processing to step S16.

The X-ray diagnostic apparatus 1 performs processing from step S16 to step S19 illustrated in FIG. 11 for each frame of pulse fluoroscopy. In other words, when the pulse fluoroscopy is performed, the grid potential control circuitry 113 performs the control described above for each frame of the pulse fluoroscopy.

As illustrated by the solid line in FIG. 7, when the setting value of the electric current flowing through the filament 141 is switched from I(ini)=100 mA to I(fin)=120 mA, the temperature of the filament 141 gradually rises. Therefore, the number of thermal electrons emitted from the filament 141 increases as the temperature of the filament 141 rises. Thus, the tube current increases as the temperature of the filament 141 rises. In this case, the X-ray diagnostic apparatus 1 repeats the processing from step S16 to step S19 and gradually decreases the potential of the grid 143 along with the increase of the tube current as illustrated in FIG. 12. Thereby, the X-ray diagnostic apparatus 1 causes the tube current to be equal to 120 mA which is the target tube current.

The X-ray diagnostic apparatus 1 according to the first embodiment has been described. As described above, the grid potential control circuitry 113 switches the potential of the grid 143 to the potential where the potential gradient around the filament 141 becomes greater than the potential gradient generated by the potential of the filament 141 and the potential of the target 142. Thereby, the X-ray diagnostic apparatus 1 can switch the tube current flowing between the filament 141 and the target 142 to the target tube current which is greater than the tube current. In other words, the X-ray diagnostic apparatus 1 can immediately switch the tube current to the target tube current without waiting until the number of thermal electrons increases due to rise of the temperature of the filament 141. Therefore, even when the X-ray tube assembly 14 starts generating X-rays or even when fluoroscopic automatic brightness control is activated and the thickness of the subject P changes, the X-ray diagnostic apparatus 1 can reduce the time until the brightness of the X-ray image is stabilized to a target brightness.

The grid potential control circuitry 113 switches the potential of the grid 143 to the potential where the potential gradient around the filament 141 becomes greater than the potential gradient generated by the potential of the filament 141 and the potential of the target 142 and thereafter performs control to decrease the potential of the grid 143 when the tube current detected by the tube current detection circuitry 145 becomes greater than the target tube current and increase the potential of the grid 143 when the tube current detected by the tube current detection circuitry 145 becomes smaller than the target tube current. Thereby, the X-ray diagnostic apparatus 1 can maintain the tube current flowing between the filament 141 and the target 142 at a tube current close to the target tube current. Therefore, the X-ray diagnostic apparatus 1 can maintain the brightness of the X-ray image at a constant level.

Further, the tube current detection circuitry 145 and the filament transformer 146 are installed in the X-ray tube assembly 14. Therefore, the tube current detection circuitry 145 can immediately detect the tube current generated by the filament transformer 146 without being affected by a floating capacitance FC1 of the high-voltage cable 31 and a floating capacitance FC2 of the high-voltage cable 32. The value of the tube current detected by the tube current detection circuitry 145 is transmitted to the processing circuitry 26 through the path R that is electrically insulated from electronic components included in the X-ray tube assembly 14, the high-voltage cable 31, and the high-voltage cable 32. Therefore, the X-ray diagnostic apparatus 1 can detect an accurate value of the tube current and transmit the value to the processing circuitry 26 without being affected by the electronic components included in the X-ray tube assembly 14, the high-voltage cable 31, and the high-voltage cable 32. Therefore, the X-ray diagnostic apparatus 1 can accurately and promptly perform control of the potential of the grid 143 for each frame of the pulse fluoroscopy described above.

In the above description, a case where the grid potential control circuitry 113 performs the control of the potential of the grid 143 for each frame of the pulse fluoroscopy is used as an example. However, when the pulse fluoroscopy is performed, the grid potential control circuitry 113 may perform the control of the potential of the grid 143 at a cycle shorter than a frame rate of the pulse fluoroscopy. In this case, the X-ray diagnostic apparatus 1 performs processing as described below.

After and before the X-ray diagnostic apparatus 1 switches 100 mA which is the present tube current to 120 mA which is the target tube current, the X-ray diagnostic apparatus 1 repeats the same processing as that in step S16 to step S19 illustrated in FIG. 11 a plurality of times in each frame of the pulse fluoroscopy. Thereby, as illustrated in FIG. 15, the potential of the grid 143 is adjusted a plurality of times by the grid potential control circuitry 113 in each pulse corresponding to each frame of the pulse fluoroscopy. Therefore, as illustrated in FIG. 16, the X-ray diagnostic apparatus 1 can maintain the tube current flowing between the filament 141 and the target 142 at a value close to 100 mA or 120 mA in each frame of the pulse fluoroscopy.

Second Embodiment

An X-ray diagnostic apparatus according to a second embodiment will be described. In the second embodiment, the same reference numerals as those used in the embodiment described above will be used. Contents overlapping with the above embodiment will not be described in detail.

Figure 17:
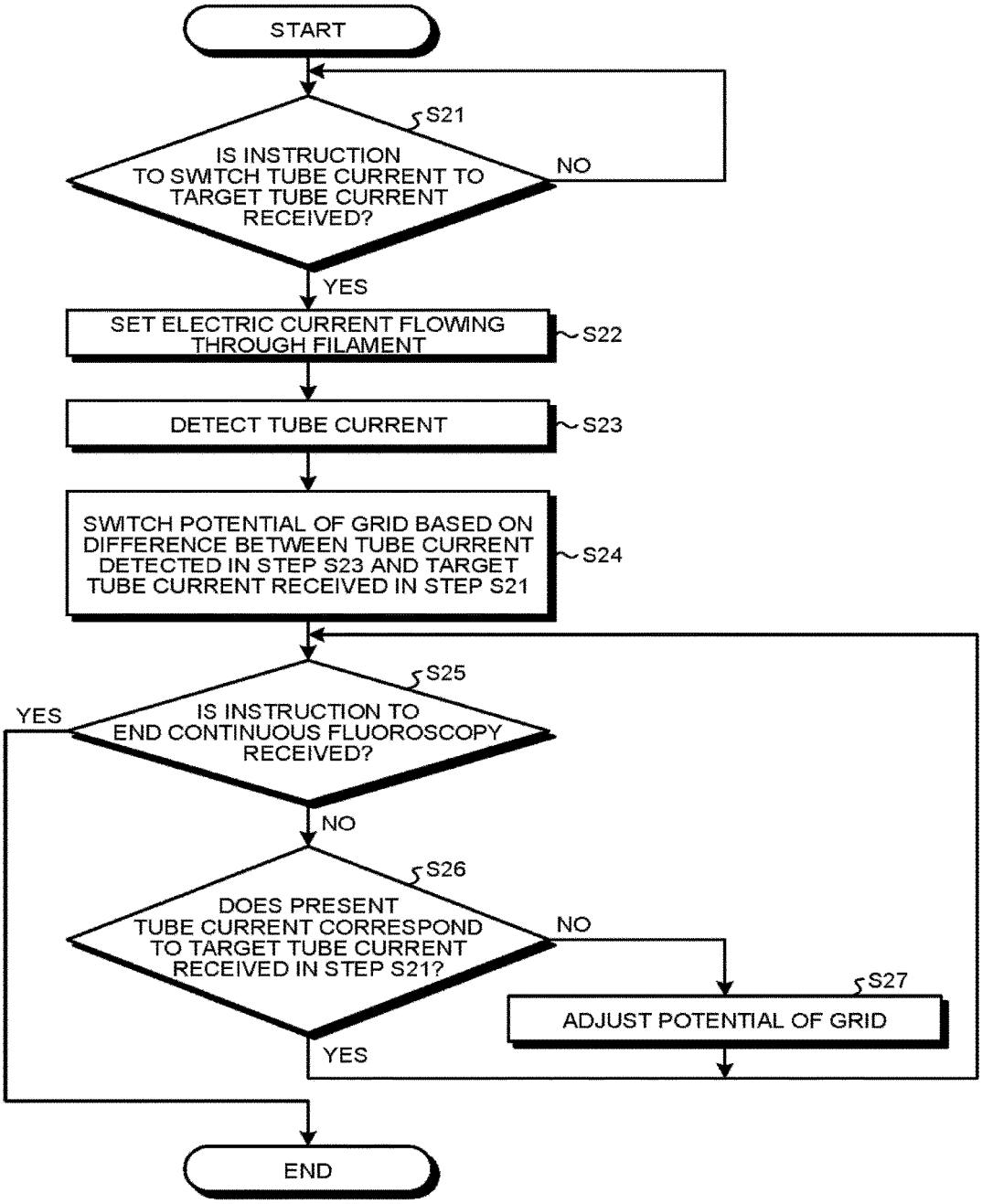
FIG. 17 is a flowchart illustrating an example of processing performed by an X-ray diagnostic apparatus according to a second embodiment.
Figure 18:
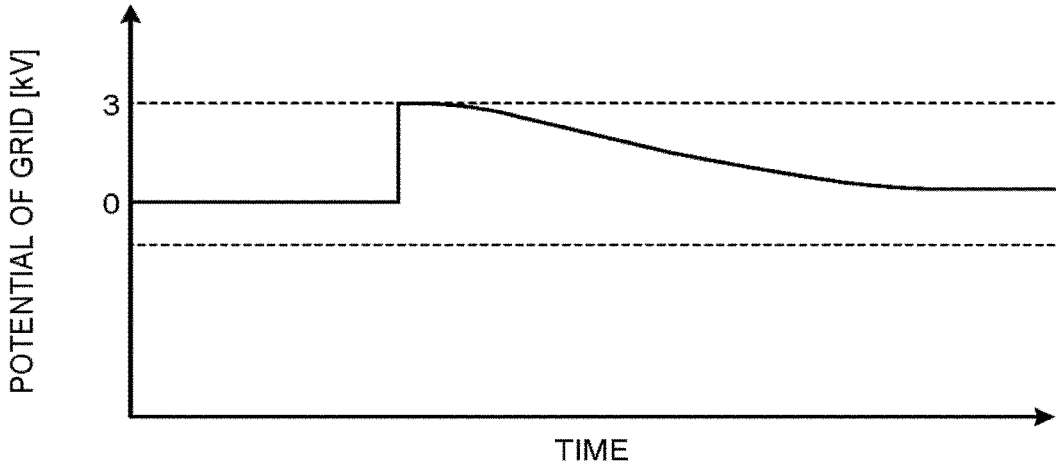
FIG. 18 is a diagram illustrating an example of grid potential control performed by the grid potential control circuitry according to the second embodiment.
Figure 19:
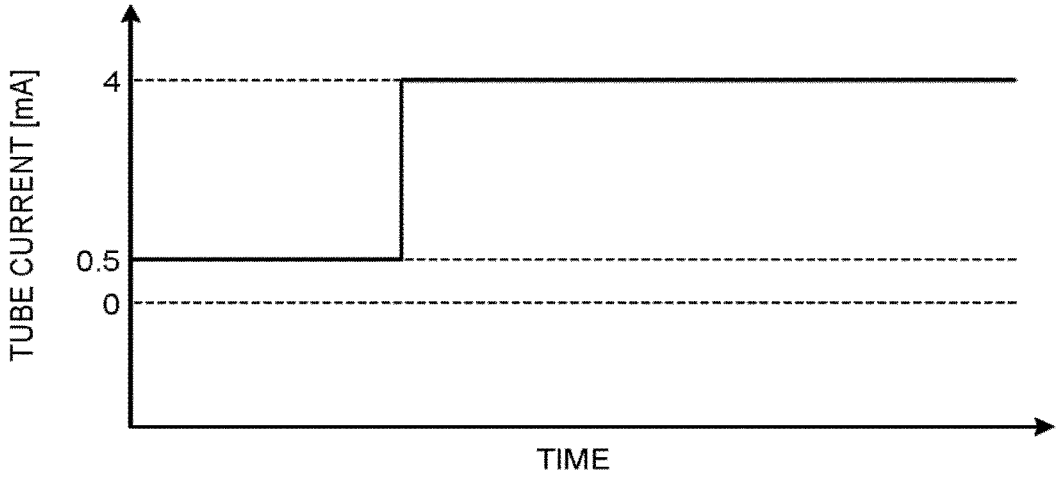
FIG. 19 is a diagram illustrating an example of time variation of a tube current by the grid potential control illustrated in FIG. 18.

In the first embodiment, a case where the X-ray diagnostic apparatus 1 performs the pulse fluoroscopy is described as an example. In the second embodiment, a case where the X-ray diagnostic apparatus 1 performs continuous fluoroscopy is described as an example with reference to FIGS. 17 to 19. FIG. 17 is a flowchart illustrating an example of processing performed by the X-ray diagnostic apparatus according to the second embodiment. FIG. 18 is a diagram illustrating an example of grid potential control performed by the grid potential control circuitry according to the second embodiment. FIG. 19 is a diagram illustrating an example of time variation of a tube current by the grid potential control illustrated in FIG. 18.

As illustrated in FIG. 17, the processing circuitry 26 reads a program corresponding to the control function 262 from the storage circuitry 25 and executes the program and thereby determines whether an instruction to switch the tube current to the target tube current is received (step S21). The processing of step S21 is the same as that of step S11 according to the first embodiment. For example, the processing circuitry 26 determines whether an instruction to switch to the target tube current of 4 mA illustrated in FIG. 19 is received.

As illustrated in FIG. 17, the filament current control circuitry 115 sets an electric current flowing through the filament 141 (step S22). For example, as illustrated by a solid line in FIG. 7, the filament current control circuitry 115 transmits a signal for switching a setting value of the electric current flowing through the filament 141 from I(ini)=0.5 mA to I(fin)=4 mA to the filament transformer 146. Thereby, the filament transformer 146 causes an electric current of I(fin) =4 mA to flow through the filament 141.

The tube current detection circuitry 145 detects the tube current (step S23). Specifically, the tube current detection circuitry 145 immediately detects the tube current. For example, the tube current detection circuitry 145 immediately detects the tube current of 0.5 mA illustrated in FIG. 19.

As illustrated in FIG. 17, the grid potential control circuitry 113 switches the potential of the grid 143 based on a difference between the tube current detected in step S23 and the target tube current received in step S21 (step S24). For example, the grid potential control circuitry 113 switches the potential of the grid 143 from 0 kV to +3 kV based on a difference between the tube current of 0.5 mA detected in step S23 and the target tube current of 4 mA received in step S21. Thereby, the potential gradient around the filament 141 is switched to a potential gradient greater than the potential gradient generated by the potential of the filament 141 and the potential of the target 142. Therefore, for example, as illustrated in FIG. 19, the grid potential control circuitry 113 can switch the tube current from 0.5 mA to 4 mA which is the target tube current.

As illustrated in FIG. 17, the processing circuitry 26 reads the program corresponding to the control function 262 from the storage circuitry 25 and executes the program and thereby determines whether an instruction to end the continuous fluoroscopy is received (step S25). When the processing circuitry 26 receives the instruction to end the continuous fluoroscopy (step S25: Yes), the processing circuitry 26 ends the processing. When the processing circuitry 26 does not receive the instruction to end the continuous fluoroscopy (step S25: No), the processing circuitry 26 advances the processing to step S26.

As illustrated in FIG. 17, the processing circuitry 26 reads the program corresponding to the control function 262 from the storage circuitry 25 and executes the program and thereby determines whether a present tube current corresponds to the target tube current received in step S21 (step S26). The processing of step S26 is the same as that of step S18 according to the first embodiment. For example, the processing circuitry 26 determines whether the present tube current corresponds to 4 mA which is the target tube current.

As illustrated in FIG. 17, the grid potential control circuitry 113 adjusts the potential of the grid (step S27). The processing of step S27 is the same as that of step S19 according to the first embodiment.

The X-ray diagnostic apparatus 1 performs processing from step S25 to step S27 at arbitrary timing.

As illustrated by the solid line in FIG. 7, when the setting value of the electric current flowing through the filament 141 is switched from I(ini)=0.5 mA to I(fin)=4 mA, the temperature of the filament 141 gradually rises. In this case, the X-ray diagnostic apparatus 1 repeats the processing from step S25 to step S27 and gradually decreases the potential of the grid 143 along with the increase of the tube current as illustrated in FIG. 18. Thereby, the X-ray diagnostic apparatus 1 causes the tube current to be equal to 4 mA which is the target tube current.

The X-ray diagnostic apparatus 1 according to the second embodiment has been described. The X-ray diagnostic apparatus 1 according to the second embodiment has the same effect as that of the X-ray diagnostic apparatus 1 according to the first embodiment.

Third Embodiment

An X-ray diagnostic apparatus according to a third embodiment will be described. In the third embodiment, the same reference numerals as those used in the embodiments described above will be used. Contents overlapping with the above embodiments will not be described in detail.

The X-ray diagnostic apparatuses 1 according to the first embodiment and the second embodiment detect the present tube current by the tube current detection circuitry 145 and thereafter switch the potential of the grid 143 based on the difference between the detected tube current and the target tube current. However, the X-ray diagnostic apparatus 1 according to the third embodiment switches the potential of the grid 143 based on a relationship between the target tube current according to a imaging condition and the potential of the grid 143.

The storage circuitry 25 stores the relationship between the target tube current according to the imaging condition and the potential of the grid 143. The storage circuitry 25 stores, for example, a relationship among the tube current flowing between the filament 141 and the target 142, the target tube current, the tube voltage, the electric current flowing through the filament 141, and the potential of the grid 143. The relationship is, for example, represented as a table illustrating a correspondence relationship among the five parameters. The relationship between the target tube current according to the imaging condition and the potential of the grid 143 is obtained by actual measurement or simulation. The term "actual measurement" here means, for example, to actually operate the X-ray diagnostic apparatus 1 and collect data related to the relationship between the target tube current according to the imaging condition and the potential of the grid 143. The term "simulation" here means, for example, to derive the relationship between the target tube current according to the imaging condition and the potential of the grid 143 by calculation.

For example, when the tube current flowing between the filament 141 and the target 142, the target tube current, and the tube voltage are set as the imaging condition, the processing circuitry 26 performs the following control by reading the program corresponding to the control function 262 from the storage circuitry 25 and executing the program. The processing circuitry 26 selects a tube current flowing between the filament 141 and the target 142, a target tube current, a tube voltage, an electric current flowing through the filament 141, and a potential of the grid 143 which are appropriate for the imaging condition from the relationships among the tube current flowing between the filament 141 and the target 142, the target tube current, the tube voltage, the electric current flowing through the filament 141, and the potential of the grid 143.

The processing circuitry 26 causes the grid potential control circuitry 113 to switch the potential of the grid 143 to the selected potential. This potential is a potential where the potential gradient around the filament 141 becomes greater than the potential gradient generated by the potential of the filament 141 and the potential of the target 142. Further, the processing circuitry 26 causes the filament current control circuitry 115 to transmit a signal for switching the electric current flowing through the filament 141 to an electric current selected from the relationship among the tube current flowing between the filament 141 and the target 142, the target tube current, the tube voltage, the electric current flowing through the filament 141, and the potential of the grid 143 to the filament transformer 146. Thereby, the X-ray diagnostic apparatus 1 can switch the present tube current to the target tube current.

After switching the present tube current to the target tube current, the X-ray diagnostic apparatus 1 repeats the same processing as steps S16 to S19 described above or the same processing as steps S25 to S27 described above. Thereby, the X-ray diagnostic apparatus 1 can cause the present tube current to be equal to the target tube current.

The X-ray diagnostic apparatus 1 according to the third embodiment has been described. As described above, the grid potential control circuitry 113 switches the potential of the grid 143 to the potential where the potential gradient around the filament 141 becomes greater than the potential gradient generated by the potential of the filament 141 and the potential of the target 142. The grid potential control circuitry 113 switches the potential of the grid 143 to the potential where the potential gradient around the filament 141 becomes greater than the potential gradient generated by the potential of the filament 141 and the potential of the target 142 and thereafter performs control to decrease the potential of the grid 143 when the tube current detected by the tube current detection circuitry 145 becomes greater than the target tube current and increase the potential of the grid 143 when the tube current detected by the tube current detection circuitry 145 becomes smaller than the target tube current. Therefore, in the same manner as the X-ray diagnostic apparatus 1 according to the first embodiment or the second embodiment, the X-ray diagnostic apparatus 1 according to the third embodiment can reduce the time until the brightness of the X-ray image is stabilized at a target brightness and maintain the brightness of the X-ray image at a constant level.

The potential of the grid 143 after being switched by the grid potential control circuitry 113 is a potential selected according to the imaging condition by the processing circuitry 26 from among the relationships between the target tube current according to the imaging condition and the potential of the grid 143. Therefore, the X-ray diagnostic apparatus 1 according to the third embodiment can switch the potential of the grid 143 to a potential where the potential gradient around the filament 141 becomes greater than the potential gradient generated by the potential of the filament 141 and the potential of the target 142 without immediately detecting the tube current and the electric current flowing through the filament 141. Therefore, in the X-ray diagnostic apparatus 1 according to the third embodiment, the tube current detection circuitry 145 and the filament transformer 146 can be installed at any position. In other words, the X-ray diagnostic apparatus 1 according to the third embodiment can have the effect described above regardless of the configuration of the high voltage generation circuitry and the X-ray tube assembly.

The filament 141 gradually becomes thin with time. Therefore, the filament 141 tends to easily emit thermal electrons with time. Therefore, the relationship between the target tube current according to the imaging condition and the potential of the grid 143 is preferable to be updated according to the thickness of the filament. Alternatively, the relationship between the target tube current according to the imaging condition and the potential of the grid 143 is preferable to be updated periodically. For example, the relationship between the target tube current according to the imaging condition and the potential of the grid 143 is updated when the X-ray diagnostic apparatus 1 is maintained.

The X-ray diagnostic apparatus 1 may perform the processing described above after replacing a part of parameters including the relationship between the target tube current according to the imaging condition and the potential of the grid 143 with a measured value. Thereby, the X-ray diagnostic apparatus 1 can maintain the brightness of the X-ray image at a constant level even when a part of parameters included in the relationship between the target tube current and the potential of the grid 143 according to the imaging condition changes.

The X-ray diagnostic apparatus 1 performs the processing described above after replacing the electric current flowing through the filament 141 with a measured value among parameters including the relationship among the tube current flowing between the filament 141 and the target 142, the target tube current, the tube voltage, the electric current flowing through the filament 141, and the potential of the grid 143. In this case, the X-ray diagnostic apparatus 1 has filament current measuring circuitry that measures an electric current flowing through the filament 141. Alternatively, the X-ray diagnostic apparatus 1 has filament temperature measuring circuitry that measures a temperature of the filament 141.

First, a case in which the X-ray diagnostic apparatus 1 has the filament current measuring circuitry will be described.

The filament current measuring circuitry measures the electric current flowing through the filament 141. The processing circuitry 26 causes the filament current control circuitry 115 to transmit a signal for switching the electric current flowing through the filament 141 to an electric current selected from the relationship among the tube current flowing between the filament 141 and the target 142, the target tube current, the tube voltage, the electric current flowing through the filament 141, and the potential of the grid 143 to the filament transformer 146 based on the electric current flowing through the filament 141 measured by the filament current measuring circuitry. Then the processing circuitry 26 causes the grid potential control circuitry 113 to switch the potential of the grid 143 to a selected potential. The potential is a potential determined from, for example, the tube current flowing between the filament 141 and the target 142, the target tube current, and the tube voltage, which are set as the imaging condition, and the electric current flowing through the filament 141 measured by the filament current measuring circuitry. In summary, the grid potential control circuitry 113 switches the potential of the grid 143 based on the relationship among the tube current flowing between the filament 141 and the target 142, the target tube current, the tube voltage, the electric current flowing through the filament 141, and the potential of the grid 143, and the electric current measured by the filament current measuring circuitry.

Next, a case in which the X-ray diagnostic apparatus 1 has the filament temperature measuring circuitry will be described. The filament temperature measuring circuitry measures the temperature of the filament 141. The processing circuitry 26 causes the filament current control circuitry 115 to transmit a signal for switching the electric current flowing through the filament 141 to an electric current selected from the relationship among the tube current flowing between the filament 141 and the target 142, the target tube current, the tube voltage, the electric current flowing through the filament 141, and the potential of the grid 143 to the filament transformer 146 based on the temperature of the filament 141 measured by the filament temperature measuring circuitry. Then the processing circuitry 26 causes the grid potential control circuitry 113 to switch the potential of the grid 143 to a selected potential. The potential is a potential determined from, for example, the tube current flowing between the filament 141 and the target 142, the target tube current, and the tube voltage, which are set as the imaging condition, and the temperature of the filament 141 measured by the filament temperature measuring circuitry. In summary, the grid potential control circuitry 113 switches the potential of the grid 143 based on the relationship among the tube current flowing between the filament 141 and the target 142, the target tube current, the tube voltage, the electric current flowing through the filament 141, and the potential of the grid 143, and the temperature measured by the filament temperature measuring circuitry. For example, the filament temperature measuring circuitry is included in a non-contact thermometer installed around the filament 141.

Figure 20:
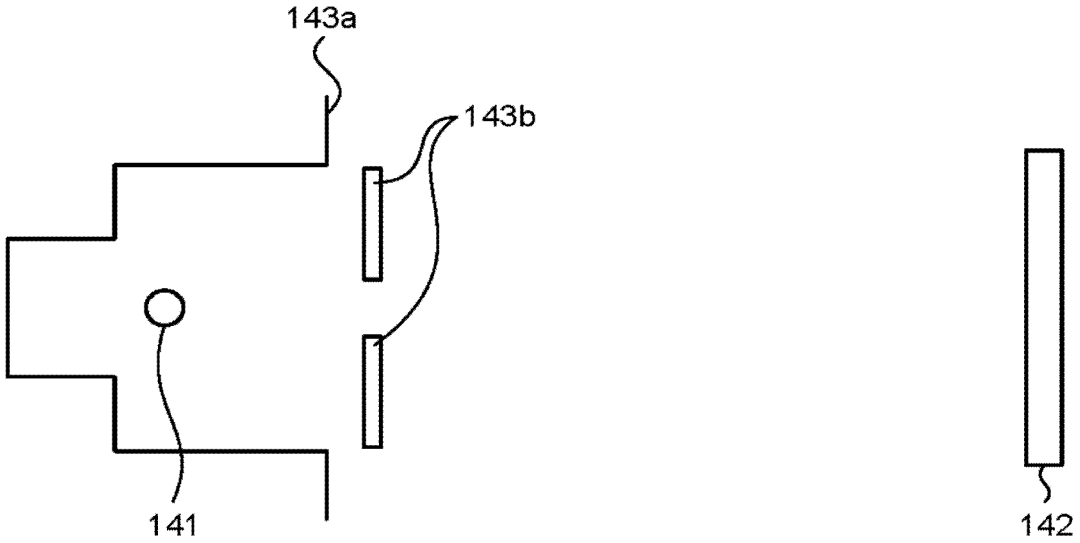
FIG. 20 is a diagram illustrating an example of a grid included in the X-ray diagnostic apparatus according to the first to the third embodiments.

The structure of the grid 143 of the X-ray diagnostic apparatuses 1 according to the first embodiment, the second embodiment, and the third embodiment is not particularly limited. For example, the grid 143 is a cup-shaped structural object in the same manner as the grid 1430 illustrated in FIG. 5. Alternatively, as illustrated in FIG. 20, the grid 143 may have a cup-shaped grid 143*a* and a plate-shaped grid 143*b*. Further, the grid 143*b* may have a mesh shape.

In the first embodiment, the second embodiment, and the third embodiment, as an example, a case is used in which the grid potential control circuitry 113 switches the potential of the grid 143 to a potential where the potential gradient around the filament 141 becomes greater than the potential gradient generated by the potential of the filament 141 and the potential of the target 142 and thereby switches the tube current flowing between the filament 141 and the target 142 to the target tube current greater than the tube current.

However, in any of the embodiments, the grid potential control circuitry 113 can switch the potential of the grid 143 to a potential where the potential gradient around the filament 141 becomes smaller than the potential gradient generated by the potential of the filament 141 and the potential of the target 142 and thereby can switch the tube current flowing between the filament 141 and the target 142 to the target tube current smaller than the tube current.

The processor described above is, for example, a CPU (Central Processing Unit), a GPU (Graphics Processing Unit), an application specific integrated circuit (ASIC), a programmable logic device (PLD), or a field programmable gate array (FPGA). The programmable logic device (PLD) is, for example, a simple programmable logic device (SPLD) or a complex programmable logic device (CPLD).

In the embodiments described above, the high voltage generation circuitry 11, the X-ray diaphragm adjusting circuitry 12, the drive circuitry 18, the generation circuitry 23, and the processing circuitry 26 realize their functions by reading a program stored in the storage circuitry 25 and executing the program. However, they are not limited to this. The program may be directly embedded in these items of circuitry instead of storing the program in the storage circuitry 25. In this case, these items of circuitry realize their function by reading the program that is directly embedded and executing the program.

The circuitry illustrated in FIG. 1 may be appropriately distributed or integrated. For example, the processing circuitry 26 may be distributed into imaging control circuitry and control circuitry which perform functions of the imaging control function 261 and the control function 262, respectively. Further, for example, the high voltage generation circuitry 11, the X-ray diaphragm adjusting circuitry 12, the drive circuitry 18, the generation circuitry 23, and the processing circuitry 26 may be arbitrarily integrated together.

According to at least one of the embodiments described above, it possible to reduce the time until the brightness of the X-ray image is stabilized to a target brightness.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray diagnostic apparatus comprising:

an X-ray tube assembly including a filament that emits electrons, a target that generates X-rays by receiving the electrons, and a grid having a potential to adjust a potential gradient around the filament; and grid potential control circuitry configured to switch the potential of the grid to a potential at which the potential gradient around the filament becomes greater than a potential gradient generated by a potential of the filament and a potential of the target.

2. The X-ray diagnostic apparatus according to claim 1, further comprising:

tube current detection circuitry configured to detect a tube current flowing between the filament and the target, wherein the grid potential control circuitry is further configured to switch the potential of the grid to the potential at which the potential gradient around the filament becomes greater than the potential gradient generated by the potential of the filament and the potential of the target, and thereafter perform control to decrease the potential of the grid when the tube current detected by the tube current detection circuitry becomes greater than a target tube current, and increase the potential of the grid when the tube current detected by the tube current detection circuitry becomes smaller than the target tube current.

3. The X-ray diagnostic apparatus according to claim 2, wherein when pulse fluoroscopy is performed, the grid potential control circuitry is configured to perform the control at a cycle shorter than a frame rate of the pulse fluoroscopy.

4. The X-ray diagnostic apparatus according to claim 2, wherein when pulse fluoroscopy is performed, the grid potential control circuitry is configured to perform the control for each frame of the pulse fluoroscopy.

5. The X-ray diagnostic apparatus according to claim 2, further comprising:

a filament transformer to control an electric current flowing through the filament; and control circuitry configured to receive a value of the tube current detected by the tube current detection circuitry and control the grid potential control circuitry based on the value, wherein the tube current detection circuitry and the filament transformer are installed in the X-ray tube assembly and the value is transmitted from the tube current detection circuitry to the control circuitry through a path different from a path through which the tube current detected by the tube current detection circuitry flows.

6. The X-ray diagnostic apparatus according to claim 3, further comprising:

a filament transformer to control an electric current flowing through the filament; and control circuitry configured to receive a value of the tube current detected by the tube current detection circuitry and control the grid potential control circuitry based on the value, wherein the tube current detection circuitry and the filament transformer are installed in the X-ray tube assembly and the value is transmitted from the tube current detection circuitry to the control circuitry through a path different from a path through which the tube current detected by the tube current detection circuitry flows.

7. The X-ray diagnostic apparatus according to claim 4, further comprising:

a filament transformer to control an electric current flowing through the filament; and control circuitry configured to receive a value of the tube current detected by the tube current detection circuitry and control the grid potential control circuitry based on the value, wherein the tube current detection circuitry and the filament transformer are installed in the X-ray tube assembly and the value is transmitted from the tube current detection circuitry to the control circuitry through a path different from a path through which the tube current detected by the tube current detection circuitry flows.

8. The X-ray diagnostic apparatus according to claim 1, wherein the grid potential control circuitry is further configured to switch the potential of the grid based on a relationship between a target tube current according to an imaging condition and the potential of the grid.

9. The X-ray diagnostic apparatus according to claim 8, wherein the relationship used by the grid potential control circuitry is obtained by actual measurement.

10. The X-ray diagnostic apparatus according to claim 8, wherein the relationship used by the grid potential control circuitry is obtained by simulation.

11. The X-ray diagnostic apparatus according to claim 8, wherein the relationship used by the grid potential control circuitry is updated according to a thickness of the filament.

12. The X-ray diagnostic apparatus according to claim 8, wherein the relationship used by the grid potential control circuitry is updated periodically.

13. The X-ray diagnostic apparatus according to claim 8, further comprising:

filament current measuring circuitry configured to measure an electric current flowing through the filament, wherein the grid potential control circuitry is further configured to switch the potential of the grid based on the relationship and the electric current measured by the filament current measuring circuitry.

14. The X-ray diagnostic apparatus according to claim 8, further comprising:

filament temperature measuring circuitry configured to measure a temperature of the filament, wherein the grid potential control circuitry is further configured to switch the potential of the grid based on the relationship and the temperature measured by the filament temperature measuring circuitry.

* * * * *